United States Patent [19]

Bessho et al.

[11] Patent Number: 4,826,169

[45] Date of Patent: May 2, 1989

[54] SLOT MACHINE WITH A MARKER SYMBOL

[75] Inventors: Naokata Bessho, Tokyo; Norio Eguchi, Tochigi, both of Japan

[73] Assignee: Kabushiki Kaisha Universal, Tochigi, Japan

[21] Appl. No.: 212,262

[22] Filed: Jun. 27, 1988

[30] Foreign Application Priority Data

Jun. 26, 1987 [JP] Japan ..... 62-157771

[51] Int. Cl.[4] ..... A63F 5/04

[52] U.S. Cl. ..... 273/143 R

[58] Field of Search ..... 273/1 E, 85 G, 85 CP, 273/138 A, 143 P

[56] References Cited

U.S. PATENT DOCUMENTS 4,721,307 11/1988 Okada ..... 273/143 R

FOREIGN PATENT DOCUMENTS 2042782 9/1980 United Kingdom .

*Primary Examiner*—Maryann Lastova

*Attorney, Agent, or Firm*—Young & Thompson

[57] ABSTRACT

A slot machine. In one embodiment, a given symbol is included in each of a series of symbols, and a judgment device is provided for locating the positions of a plurality of given symbols appearing within the windows but not all on the prize-winning line, after all the symbol series have stopped. Provision is also made for outputting a prize-winning signal when the plurality of given symbols form a predetermined arrangement. Symbol series stop position adjustment is also made, responsive to the prize-winning signal, for automatically causing at least one of the plurality of symbol series to move for the adjustment of stop position so as to attain a prize-winning symbol combination of the given symbols on the prize-winning line. In another embodiment, a specific symbol is included in one of the series of symbols; and the judgment device outputs a prize-winning signal when that specific symbol is positioned on the prize-winning line after all the symbol series have stopped. Again, symbol series stop position adjustment is made, responsive to the prize-winning signal, for automatically causing at least one of the plurality of symbol series to move so as to obtain a predetermined prize-winning symbol combination on the prize-winning line.

8 Claims, 3 Drawing Sheets

SLOT MACHINE WITH A MARKER SYMBOL

BACKGROUND OF THE INVENTION

1. Field of the Invention

The present invention relates to slot machines, and more particularly to slot machines wherein even if a combination of symbols on a prize-winning line is not a predetermined prize-winning combination of symbols, but nevertheless a certain condition is satisfied, then at least one series of symbols is automatically moved to form a prize-winning symbol combination.

2. Description of the Prior Art

A slot machine has a plurality of series of symbols, each series having a plurality of different symbols disposed at equal pitch. Slot machines are classified into the mechanical reel type and the video type, the former having a symbol series disposed on the periphery of each reel, and the latter simulating such symbol series of a CRT. To play games, coins (including tokens) are inserted. After a predetermined time, the rotating or simulated rotating symbol rows are caused automatically and sequentially to stop. Alternatively, the rotating or simulated rotating symbol rows are forced to stop sequentially upon actuation of stop buttons. Whether a prize has been won is determined based on the combination of symbols stopped on a prize-winning line within display windows.

Slot machines are known which are of the type in which if a specific symbol is stopped within a window or a plurality of symbols satisfying a specific condition are stopped within windows, symbol series are allowed to rotate forward or backward by an amount corresponding to several symbols upon actuation of buttons or the like. After thus adjusting the stopped positions of the symbol series, if a combination of symbols on a prize-winning line becomes one of the prize-winning symbol combinations, coins are paid out the number of which depends on the rank of the prize-winning symbol combination. Such a function is called a "nudge" function which effectively increases the player's interest in playing slot machine games.

With slot machines having a nudge function, it is possible to obtain a prize-winning symbol combination by using this nudge function. However, in this case, in contrast with a uniform prize-winning symbol combination, various symbols appear at random within the windows so that it is difficult for average players to recognize the symbols as those symbols which can be rearranged into a prize-winning symbol combination. Thus, players are likely to lose games unnecessarily. In addition, in order to win by means of a nudge function, players are required to perform the manual actuation of buttons with great skill. Moreover, even for skilled players who repetitively play games in a short period of time, it becomes cumbersome to actuate as many buttons as the number of reels or simulations of reels.

OBJECT OF THE INVENTION

The object of the present invention is, therefore, to improve such a nudge function and to provide a slot machine wherein a prize-winning combination of symbols can be achieved even by average players.

SUMMARY OF THE INVENTION

For achieving the above-mentioned and other objects and the advantages, the slot machine in accordance with the present invention comprises a given symbol included in each of N series of symbols. Judgment means locate the positions of a plurality of given symbols appearing within the windows after all the symbol series have stopped, and output a prize-winning signal when the plurality of given symbols form a predetermined arrangement. Symbol series stop position adjusting means are provided, which are responsive to this prize-winning signal for automatically causing at least one of the plurality of symbol series to move for the adjustment of its stop position and to provide a prize-winning symbol combination of the given symbols on a prize-winning line.

According to another embodiment of this invention, a specific symbol is included in at least one symbol series. If the specific symbol stops on the prize-winning line, all the symbol series are allowed to move automatically and to complete a specific prize-winning symbol combination.

In a slot machine according to this invention, although a prize-winning combination is provided which is difficult for players to recognize, when a given arrangement of symbols or the specific prize-winning symbol is displayed upon the stopping of all the symbol series, they are allowed automatically to start moving and to complete a usual prize-winning symbol combination on a prize-winning line readily recognizable by players. Players will thus pay more attention to the specific prize-winning symbol and have more interest in playing games.

DETAILED DESCRIPTION OF THE INVENTION

Figure 1:
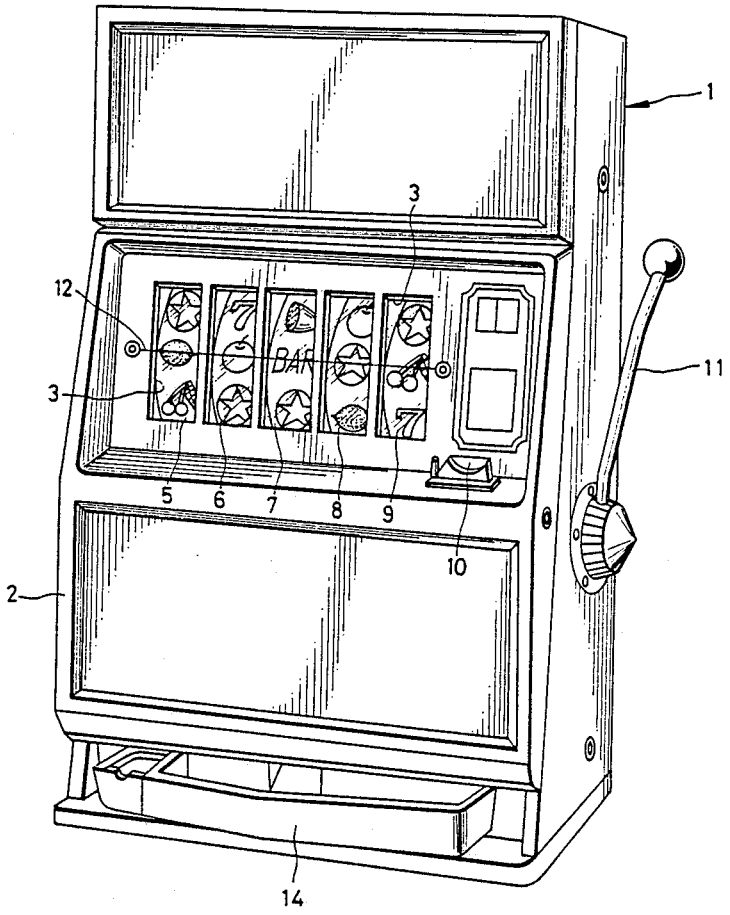
FIG. 1 shows an example of the overall structure of a slot machine according to the present invention.

FIG. 1 shows a slot machine of a five-reel type embodying the present invention. Five display windows 3 generally extending vertically are formed in a front panel 2 of a main body Symbols disposed on the peripheries of first to fifth reels 5 to 9 rotatable within the main body 1 can be observed through the windows 3. Each window 3 allows three symbols to be displayed so that 15 symbols of 3 lines × 5 series can be observed at a time.

Prior to starting a game, coins are inserted into a coin slot 10. When a start lever 11 is pulled, the first to fifth reels 5 to 9 start rotating at the same time. The reels 5 to 9 automatically and sequentially stop at random timings. When all the reels have stopped, if a combination of symbols appearing at the center of each window 3, i.e. stopping on the prize-winning line 12, is one of the predetermined prize-winning symbol combinations, a predetermined number of coins corresponding to the prize-winning rank are paid out into a coin saucer 14. Stop buttons (not shown) may alternatively be used to stop each reel manually.

Figure 2:
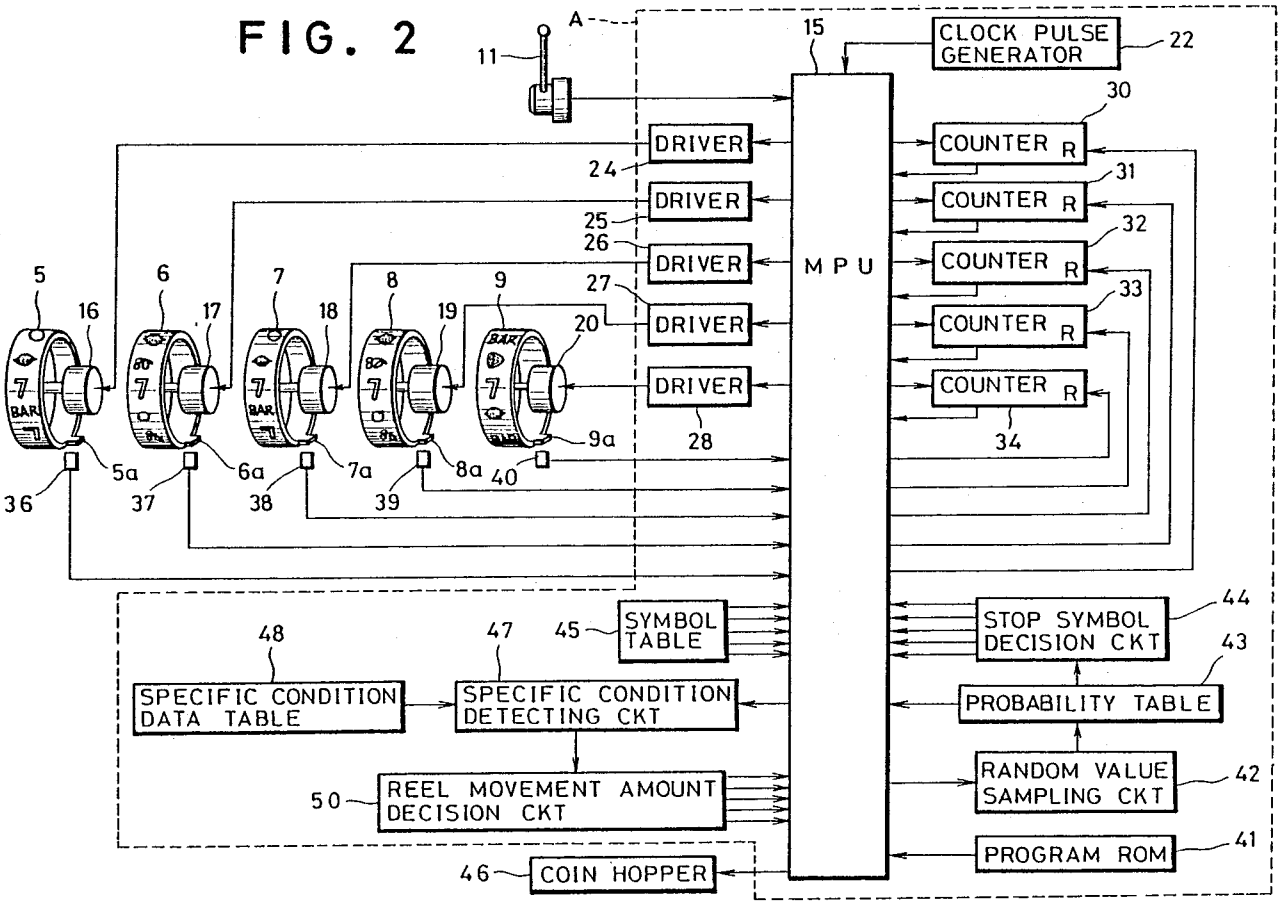
FIG. 2 is a schematic block diagram of a control circuit of the slot machine shown in FIG. 1.

FIG. 2 is a block diagram of a circuit for controlling the operation of the slot machine. The first to fifth reels 5 to 9 are caused to rotate by means of stepping motors 16 to 20, respectively, which are controlled by a microprocessor 15 (hereinafter called MPU). In particular, clock pulses from a clock pulse generator 22 are supplied to MPU 15 which actuates drivers 24 to 28. The amount of rotary movement of each stepping motor 16 to 20 corresponds to the number of clock pulses.

The number of clock pulses by which each stepping motor 16 to 20 is rotated is counted by a respective counter 30 to 34. Each reel 5 to 9 is provided with a tongue 5*a* to 9*a* which is detected by a respective photosensor 36 to 40 to generate a reset signal every one rotation of the reel. The reset signal causes the respective counter 30 to 34 to reset to a "0" count. Consequently, the count of each counter 30 to 34 corresponds to the rotary angle of its respective reel 5 to 9. Since a reference position of each reel 5 to 9 and the number and type of symbols disposed at constant pitch starting from the reference position are previously known, the nature of the symbols on the prize-winning line 12 can be identified by referring to the counts of the counters 30 to 34. A circuit portion enclosed by a broken line A in FIG. 2 is assembled as a microcomputer. A sequence program for controlling the entire procedure of playing games is stored in a program ROM 41.

A random number sampling circuit 42 samples an optical random number which falls within a predetermined range of random number values after the start lever 11 is pulled. A probability table 43 connected to the random number sampling circuit 42 stores data based on which the predetermined range of random number values is classified into a big hit area, a middle hit area, a small hit area, and a lost game area. The probability table 43 is used for judging in which area a sampled random number belongs. The judged result is supplied to a stop symbol decision circuit 44 which decides a symbol arrangement corresponding to a prize-winning combination (or a lost game combination) judged by the probability table 43.

MPU 15 controls the operation of the drivers 24 to 28 in accordance with the decided symbol arrangement. A symbol table stores data on the correspondence between the counts of the counters 30 to 34 and the symbols for each reel. Thus, by referring to the symbol table 45 and checking the counts of the counters 30 to 34, the rotation of the reels 5 to 9 can be controlled such that symbols decided by the stop symbol decision circuit 44 are stopped on the prize-winning line 12. The symbols stopped on the prize-winning line 12 accordingly correspond to the prize-winning combination decided by the probability table 43. After the reels 5 to 9 stop and if a prize-winning combination is obtained, then a coin hopper 46 is actuated to pay out divided coins.

Figure 3:
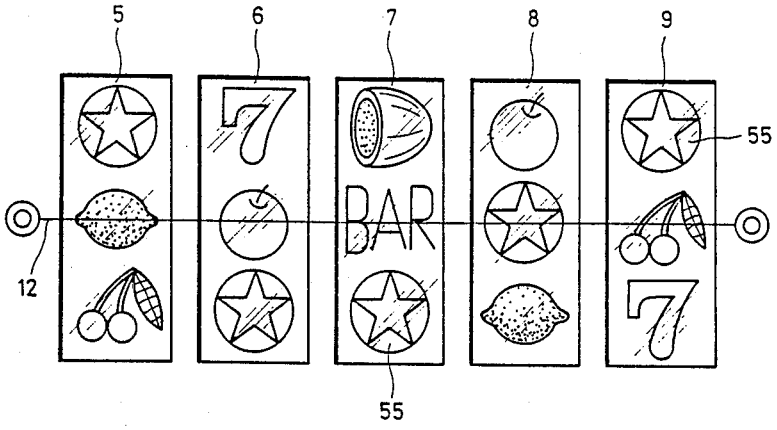
FIG. 3 shows a symbol arrangement of a scattered prize-winning combination.

The slot machine of this invention is provided with a specific condition detecting circuit 47, a specific condition data table 48 and a reel movement amount decision circuit 50. After the reels 5 to 9 stop, the specific condition detecting circuit 47 judges whether a specific prize-winning combination was obtained or not by checking the counts of the counters 30 to 34 with reference to the specific condition data table 48. An example of a specific prize-winning combination is the case wherein stars 55 stop within the windows of all the reels 5 to 9, as shown in FIG. 3. The stars 55 need not be aligned on the prize-winning line as in the case of an ordinary prize-winning combination. Such a specific prize-winning arrangement is called in this technical field a scattered winning or a scat winning arrangement.

In the present embodiment, a specific prize-winning arrangement is judged using the specific condition detecting circuit 47 and the specific condition data table 48. The specific condition data table 48 accordingly stores the counts of the counters 30 to 34, which counts correspond to the positions wherein the stars 55 of the reels 5 to 9 appear within the display windows. If a scattered winning arrangement is confirmed after the stopping of all the reels by the specific condition detecting circuit 47, MPU 15 first actuates the coin hopper 46 to pay out a fraction of dividend coins corresponding in number to the scattered winning arrangement. For example, the number of divided coins paid out at this time might be 10 coins.

The specific condition detecting circuit 47 then detects whether the stars 55 of the reels 5 to 9 are on the prize-winning line or displaced therefrom, by referring to the counts of the counters 30 to 34. The detection signals are supplied to the reel movement amount decision circuit 50 which then supplies signals to MPU 15 for driving necessary ones of the stepping motors 16 to 20. Then, the reels 5, 6, 7 and 9 having the stars 55 displaced from the prize-winning line 12 are caused to rotate forward or backward by an amount corresponding to one symbol frame to align all the stars 55 of the reels 5 to 9 on the prize-winning line 12. After this operation, the coin hopper 46 is again actuated to pay out the remaining number of dividend coins, e.g. 20, into the coin saucer 14. The above process for a scattered prize-winning arrangement serves to cause players to pay more attention to the scattered prize-winning arrangements and to cause to have a greater interest in playing games.

Figure 4:
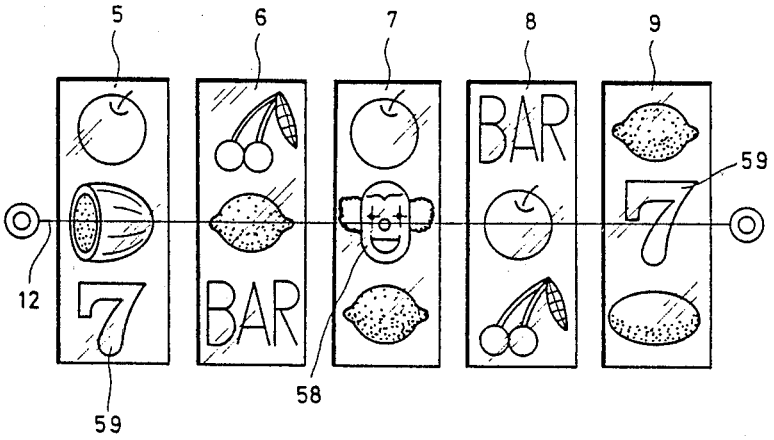
FIG. 4 shows a symbol arrangement for a one-point prize-winning display including a specific symbol.

A specific prize-winning symbol may be of the type shown in FIG. 4. In particular, a "pierrot" or clown mark 58 is provided only on the third reel 7. A one-point prize is given if the clown mark 58 stops on the prize-winning line 12 irrespective of the stop positions of the other reels. In case of a one-point prize, a fraction of the dividend coins are paid out at the time when the reels 5 to 9 stop as shown in FIG. 4. Thereafter, the reels 5 to 9 are caused to move by an amount corresponding to as many symbol frames as are sufficient for the same symbol, e.g. "7" on all the reels to be aligned on the prize-winning line 12, thereby completing a prize-winning combination "all sevens". Then, a predetermined number of remaining dividend coins for the "all sevens" are paid out.

In the above embodiment, a specific prize-winning symbol has been detected after the stopping of the reels 5 to 9 by the specific condition detecting circuit 47. However, a specific prize-winning symbol may be decided by the probability table 43 and the stop symbol decision circuit 44. In this case, by using the stop symbol decision circuit 44, the reels 5 to 9 are temporarily stopped at the positions shown in FIG. 3 or FIG. 4 and thereafter, the reels 5 to 9 are caused to move again to the stop positions corresponding to a predetermined prize-winning combination.

Furthermore, the invention is applicable not only to the above-described five-reel type slot machines but also to three- or four-reel type slot machines. Not only a single prize-winning line but also three or five prize-winning lines may be used, as is well known. Furthermore, not only slot machines wherein each symbol series is provided on a reel or an endless belt with symbols disposed on the periphery or outer surface thereof, but also video-type slot machines wherein each symbol series is displayed on a CRT screen using graphic data, may be used.

What is claimed is:

1. In a slot machine in which plural moving symbol series are adapted to stop so as to display a combination of symbols on a prize-winning line within display windows in which are also displayed other symbols in said series that are displaced from said prize-winning line, and in which coins corresponding in number to predetermined prize-winning symbol combinations are paid out upon the appearance of a said prize-winning combination on said line; the improvement comprising:

a given symbol included in each of said series of symbols;

judgment means for locating the positions of a plurality of said given symbols appearing within said windows but not all on said prize-winning line after all the symbol series have stopped, and for outputting a prize-winning signal when said plurality of given symbols form a predetermined arrangement; and symbol series stop position adjusting means responsive to said prize-winning signal for automatically causing at least one of said plurality of symbol series to move for the adjustment of stop position so as to attain a prize-winning symbol combination of said given symbols on said prize-winning line.

2. A slot machine as defined in claim 1, wherein when said prize-winning signal is obtained, a fraction of dividend coins are paid out, and when said symbol series stop position adjustment means operates to align said given symbols on said prize-winning line, the remaining dividend coins for the combination of said given symbols on said prize-winning line are paid out.

3. A slot machine as defined in claim 1, wherein said symbol series is depicted on the outer periphery of a reel rotated by a pulse motor.

4. A slot machine as defined in claim 1, wherein said given symbol is a star.

5. In a slot machine in which plural moving symbol series are adapted to stop so as to display a combination of symbols on a prize-winning line within display windows, and in which coins corresponding in number to predetermined prize-winning symbol combinations are paid out upon the appearance of a said prize-winning combination on said line; the improvement comprising:

a specific symbol included in one of said series of symbols;

judgment means for outputting a prize-winning signal when said specific symbol is positioned on said prize-winning line after all the symbol series have stopped; and symbol series stop position adjusting means responsive to said prize-winning signal for automatically causing at least one of said plurality of symbol series to move so as to obtain a predetermined prize-winning symbol combination on said prize-winning line.

6. A slot machine as defined in claim 5, wherein when said prize-winning signal is obtained, a fraction of dividend coins are paid out, and when said symbol series stop position adjusting means operates, the remaining dividend coins for said predetermined prize-winning symbol combination are paid out.

7. A slot machine as defined in claim 5, wherein said symbol series is depicted on the outer surface of a reel rotated by a pulse motor.

8. A slot machine as defined in claim 5, wherein said specific symbol is a clown.

* * * * *